US011324363B2

(12) United States Patent
Pomplun et al.

(10) Patent No.: US 11,324,363 B2
(45) Date of Patent: May 10, 2022

(54) ELEVATED TOILET SEAT ASSEMBLY

(71) Applicant: Bemis Manufacturing Company, Sheboygan Falls, WI (US)

(72) Inventors: Brian Pomplun, Cedarburg, WI (US); Brian A. Henne, Elkhart Lake, WI (US); Jonathan Arndt, Sheboygan, WI (US); Patrick J. Raymakers, Sheboygan, WI (US)

(73) Assignee: BEMIS MANUFACTURING COMPANY, Sheboygan Falls, WI (US)

( * ) Notice: Subject to any disclaimer, the term of this patent is extended or adjusted under 35 U.S.C. 154(b) by 0 days.

(21) Appl. No.: 16/561,594

(22) Filed: Sep. 5, 2019

(65) Prior Publication Data

US 2020/0077848 A1 Mar. 12, 2020

Related U.S. Application Data

(60) Provisional application No. 62/729,196, filed on Sep. 10, 2018.

(51) Int. Cl.

| | |
|---|---|
| ***A47K 13/00*** | (2006.01) |
| ***A47K 13/02*** | (2006.01) |
| ***A47K 13/12*** | (2006.01) |

(52) U.S. Cl.

CPC ..... *A47K 13/005* (2013.01); *A47K 13/02* (2013.01); *A47K 13/12* (2013.01)

(58) Field of Classification Search

CPC ..... A47K 13/005; A47K 13/02; A47K 13/12
USPC ..... 4/237, 667, 254, 300.3
See application file for complete search history.

(56) References Cited

U.S. PATENT DOCUMENTS

| | | | | |
|---|---|---|---|---|
| 2,932,830 A | | 4/1960 | Lund | |
| 3,249,950 A | | 5/1966 | Wilson | |
| 3,594,831 A | * | 7/1971 | Brewer | A47K 13/005 4/237 |

(Continued)

FOREIGN PATENT DOCUMENTS

| | | |
|---|---|---|
| CN | 2089312 U | 11/1991 |
| CN | 102949140 A | 3/2013 |

(Continued)

OTHER PUBLICATIONS

Affordable Medical Equipment, "Elevated Toilet Seats," <http://medame.com/elevated-toilet-seats.html> webpage accessed Jun. 6, 2018.

(Continued)

*Primary Examiner* — Tuan N Nguyen
(74) *Attorney, Agent, or Firm* — Michael Best & Friedrich LLP

(57) ABSTRACT

An elevated toilet seat assembly is for a toilet and includes a hinge post configured to be coupled to the toilet and a toilet seat pivotably coupled to the hinge post about an axis. The toilet seat is made from a single piece of injection molded plastic. The toilet seat includes a support surface configured to support a person on the toilet seat and a guard extending below the support surface. The guard is configured to block waste from splashing out of the toilet during use. The toilet seat also includes a plurality of supports extending outwardly from an outer surface of the guard. The plurality of supports is configured to engage a rim of the toilet to position the support surface at an elevated height above the rim.

17 Claims, 5 Drawing Sheets

(56) References Cited

U.S. PATENT DOCUMENTS

| | | | | |
|---|---|---|---|---|
| 3,935,601 | A | 2/1976 | Hermann | |
| 4,214,323 | A | 7/1980 | Thomas | |
| 4,276,663 | A | 7/1981 | Gensurowsky | |
| 4,517,689 | A | 5/1985 | Smith et al. | |
| 4,807,308 | A | 2/1989 | Person et al. | |
| 5,251,338 | A | 10/1993 | Light | |
| 5,412,815 | A | 5/1995 | Ellis | |
| 5,432,956 | A | 7/1995 | Park | |
| 5,920,917 | A | 7/1999 | Landsberger | |
| 5,996,133 | A | 12/1999 | Fletcher | |
| 6,052,840 | A * | 4/2000 | West | A47K 13/06 4/300.3 |
| 6,081,943 | A | 7/2000 | Garcete | |
| D448,459 | S | 9/2001 | Hulsebus et al. | |
| 6,360,382 | B1 | 3/2002 | Karash | |
| 6,418,566 | B1 | 7/2002 | Plonta | |
| RE38,191 | E | 7/2003 | Otte | |
| 6,986,173 | B1 | 1/2006 | Hickey | |
| 7,073,210 | B2 | 7/2006 | Jiang | |
| 7,240,377 | B2 * | 7/2007 | Vanden Heuvel | A47K 13/12 4/237 |
| 8,082,603 | B2 | 12/2011 | Leibfried | |
| 8,166,581 | B2 | 5/2012 | Lovatt | |
| 8,499,368 | B2 | 8/2013 | Wunderlich et al. | |
| 8,763,169 | B2 | 7/2014 | Daniels et al. | |
| 8,893,317 | B2 | 11/2014 | Smith | |
| 8,925,120 | B2 | 1/2015 | Khiroya | |
| 9,021,620 | B1 | 5/2015 | Walker | |
| 9,439,544 | B1 | 9/2016 | DeCarlo | |
| D771,227 | S | 11/2016 | Yeung | |
| D838,821 | S | 1/2019 | Wong | |
| 2004/0025234 | A1 | 2/2004 | Moser et al. | |
| 2006/0156459 | A1 * | 7/2006 | Hsu | A47K 13/24 4/237 |
| 2007/0113328 | A1 | 5/2007 | Cheng | |
| 2008/0034483 | A1 | 2/2008 | Schanz | |
| 2011/0191952 | A1 | 8/2011 | Brazier | |
| 2013/0000028 | A1 | 1/2013 | Desai | |
| 2013/0283515 | A1 | 10/2013 | Schilpp et al. | |
| 2014/0101832 | A1 | 4/2014 | Wagner et al. | |
| 2015/0351594 | A1 * | 12/2015 | Veros | A47K 13/24 4/237 |

FOREIGN PATENT DOCUMENTS

| | | | |
|---|---|---|---|
| CN | 106175548 | A | 12/2016 |
| CN | 107280560 | A | 10/2017 |
| DE | 10136216 | A1 | 5/2003 |
| EP | 1588657 | B1 | 6/2009 |
| EP | 2918210 | A1 | 9/2015 |
| EP | 2640904 | B1 | 11/2016 |
| JP | H07255641 | A | 10/1995 |
| JP | 2014239872 | A2 | 12/2014 |
| WO | 1997/41765 | A1 | 11/1997 |
| WO | 2007/122407 | A1 | 11/2007 |
| WO | 2015/122676 | A1 | 8/2015 |

OTHER PUBLICATIONS amazon.com, "Carex Hinged Toilet Seat Riser, Adds 3.5 Inches of Height to Toilet, 300 Pound Weight Capacity, Hinged for Easy Cleaning," <https://www.amazon.com/Carex-Hinged-Toilet-Capacity-Cleaning/dp/B008XML0T2> webpage accessed Jan. 24, 2018.

amazon.com, "Premium Soft Close White D-Shape Toilet Seat for Young Families | Child Friendly, Very Strong Seat, Perfect for Potty Training | Includes Top & Bottom Fixing Hinges by EcoSpaÂ by EcoSpa," <https://www.amazon.com/Premium-D-Shape-Families-Friendly-Training/dp/B015SZ2TSW> webpage accessed Jun. 6, 2018.

Drive Medical, "Hinged Toilet Seat Riser," <http://www.drivemedical.com/index.php/hinged-toilet-seat-riser-2918.html> webpage accessed Jan. 24, 2018.

Durable Medical Equipment, "Online Catalog," <https://www.dmeinc.biz/resource/products/products/productlistac76.html?Cat=5> webpage accessed Jun. 6, 2018.

rehabmart.com, "Maddak Hinged Elevated Toilet Seat," <https://www.rehabmart.com/product/hinged-elevated-toilet-seat-18487.html> webpage accessed Jan. 24, 2018.

rehabmart.com, "Savanah Raised Toilet Seat with Lid," <https://www.rehabmart.com/product/savanah-raised-toilet-seat-with-lid-1-10861.html> webpage accessed Jan. 24, 2018.

European Patent Office Extended Search Report for Application No. 19196186.1 dated Dec. 20, 2019 (9 pages).

Chinese Patent Office Action for Application No. 201910851880.6 dated Jan. 30, 2022 (14 pages including English translation).

* cited by examiner

ELEVATED TOILET SEAT ASSEMBLY

CROSS-REFERENCE TO RELATED APPLICATIONS

This application claims priority to U.S. Provisional Patent Application No. 62/729,196, filed Sep. 10, 2018, the content of which is incorporated herein by reference.

FIELD OF THE INVENTION

The present invention relates to toilet seat assemblies, and more particularly to elevated toilet seat assemblies that assist in helping a person sit down on and stand up from a toilet.

SUMMARY

In one aspect, an elevated toilet seat assembly is for a toilet and includes a hinge post configured to be coupled to the toilet and a toilet seat pivotably coupled to the hinge post about an axis. The toilet seat is made from a single piece of injection molded plastic. The toilet seat includes a support surface configured to support a person on the toilet seat and a guard extending below the support surface. The guard is configured to block waste from splashing out of the toilet during use. The toilet seat also includes a plurality of supports extending outwardly from an outer surface of the guard. The plurality of supports is configured to position the support surface at an elevated height above the rim.

In another aspect, an elevated toilet seat assembly is for a toilet and includes a toilet seat configured to be pivotably coupled to the toilet about an axis. The toilet seat includes a support surface having an inner top edge defining a top opening of the toilet seat. The support surface is configured to support a person on the toilet seat. The elevated toilet seat assembly also includes a guard extending below the support surface. The guard has an inner bottom edge defining a bottom opening of the toilet seat. The guard is configured to block waste from splashing out of the toilet during use. The guard tapers from the inner bottom edge of the guard toward the inner top edge of the support surface.

In yet another aspect, an elevated toilet seat assembly is for a toilet and includes a toilet seat configured to be pivotably coupled to the toilet about an axis in at least an in-use position in which the toilet seat engages a rim surface of the toilet. The toilet seat includes a support surface having an inner top edge defining a top opening. The support surface is configured to support a person on the toilet seat. The elevated toilet seat assembly also includes a guard extending below the support surface. The guard has an inner bottom edge defining a bottom opening of the toilet seat. The guard is configured to block waste from splashing out of the toilet during use. A plane is configured to be perpendicular to the rim surface of the toilet and extends through the top and bottom openings when the toilet seat is in the in-use position. A first distance, measured within the plane between opposing points on the inner top edge, is less than a second distance, measured within the plane between opposing points on the inner bottom edge.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings. Terms of degree, such as "substantially" or "approximately" are understood by those of ordinary skill to refer to reasonable ranges outside of the given value, for example, general tolerances associated with manufacturing, assembly, and use of the described embodiments.

Figure 1:
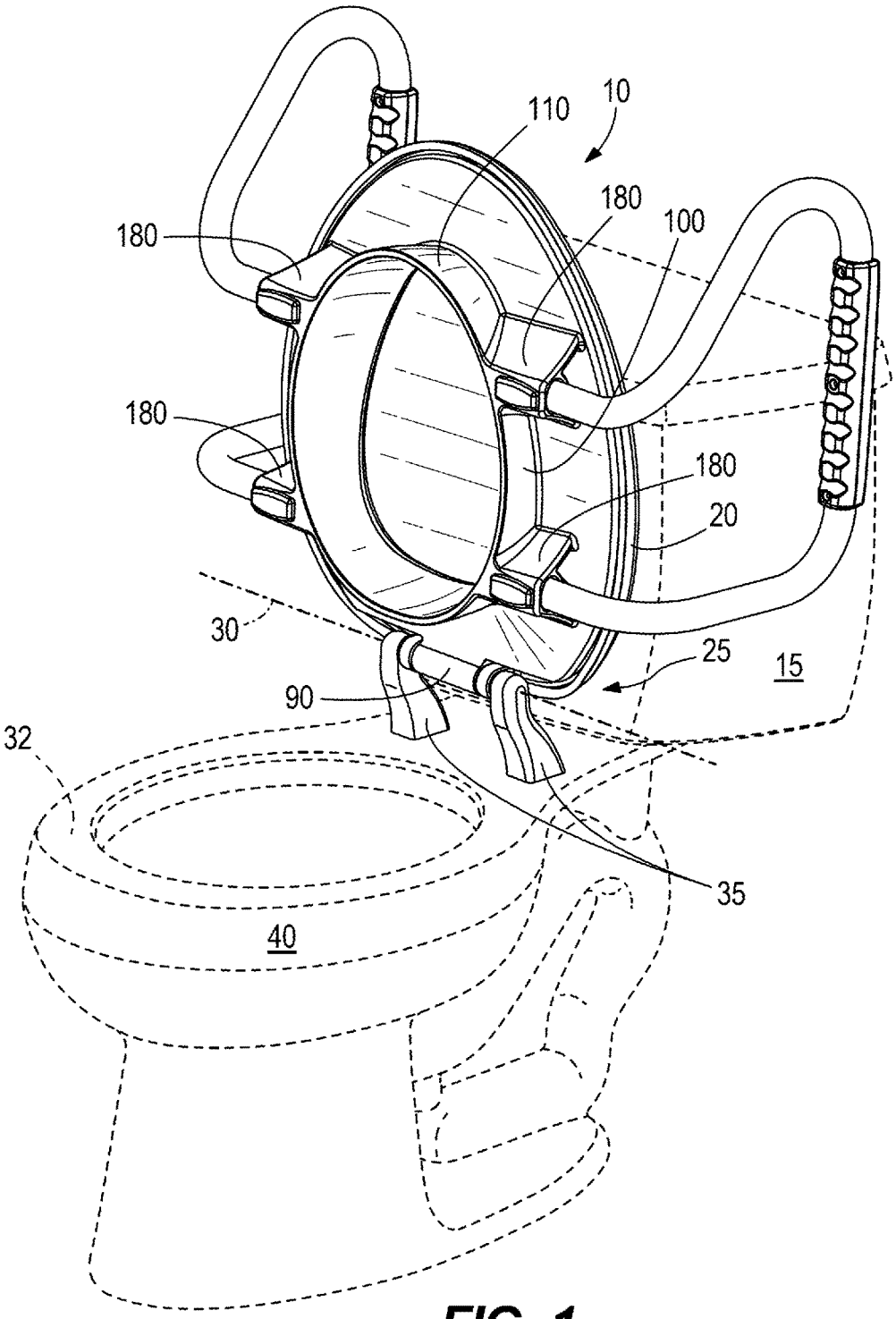
FIG. 1 is a perspective view of an elevated toilet seat assembly according to an embodiment of the invention, the toilet seat assembly coupled to a toilet in a raised position.
Figure 2:
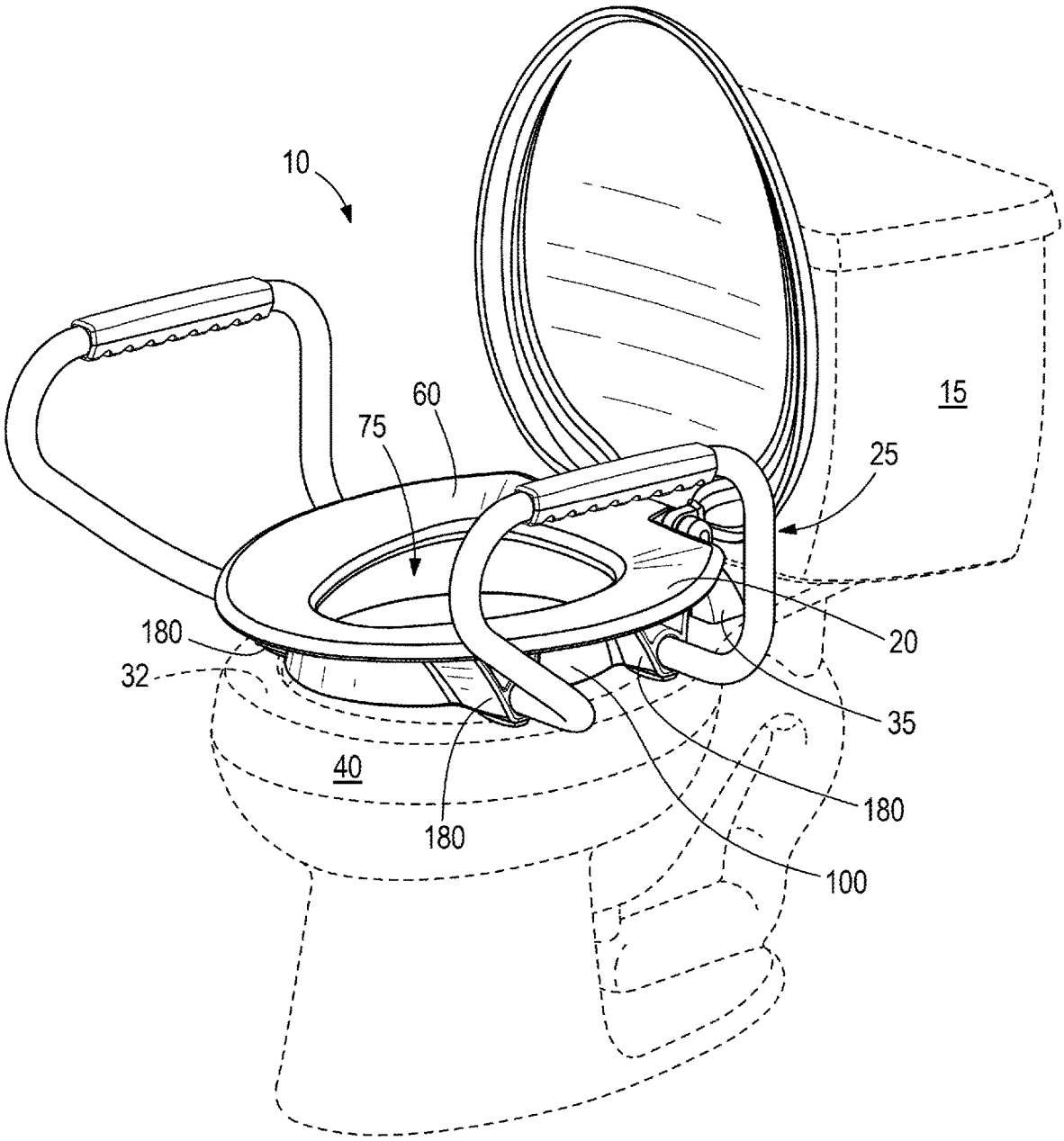
FIG. 2 is a perspective view of the elevated toilet seat assembly of FIG. 1 in a lowered position.
Figure 4:
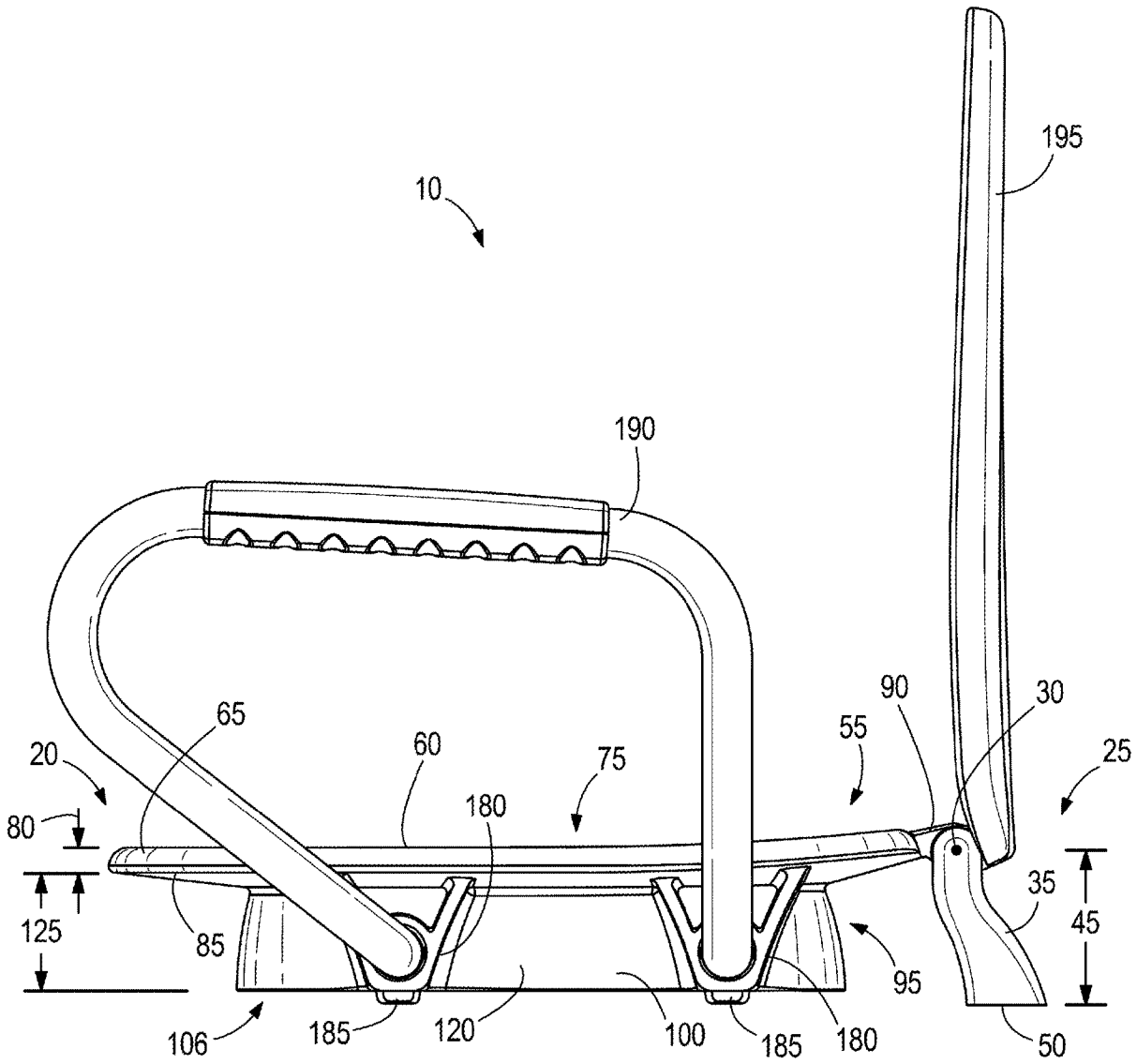
FIG. 4 is a side view of the elevated toilet seat assembly of FIG. 3.

FIGS. 1 and 2 illustrate an elevated toilet seat assembly 10 coupled to a toilet 15. The toilet seat assembly 10 includes a toilet seat 20 pivotably coupled to a hinge post 25 about an axis 30 between a first position (FIG. 1) and a second position (FIG. 2). The first position is a raised or upright position. The second position is a lowered or in-use position when the toilet seat 20 engages a rim surface 32 of the toilet 15. The hinge post 25 includes two post members 35 that are coupled to a base 40 of the toilet 15. The hinge post 25 can be fixed to the base 40 by fasteners or selectively coupled to the base 40 by a quick-disconnect feature. In other embodiments, the hinge post 25 can include one post member coupling the toilet seat 20 to the base 40. In the illustrated embodiment, a height 45 of the hinge post 25 (i.e., a distance between the axis 30 and a bottom surface 50 of the hinge post 25; FIG. 4) is between about 3 inches and about 5 inches. In some embodiments, the height 45 of the hinge post 25 is about 4 inches.

Figure 3:
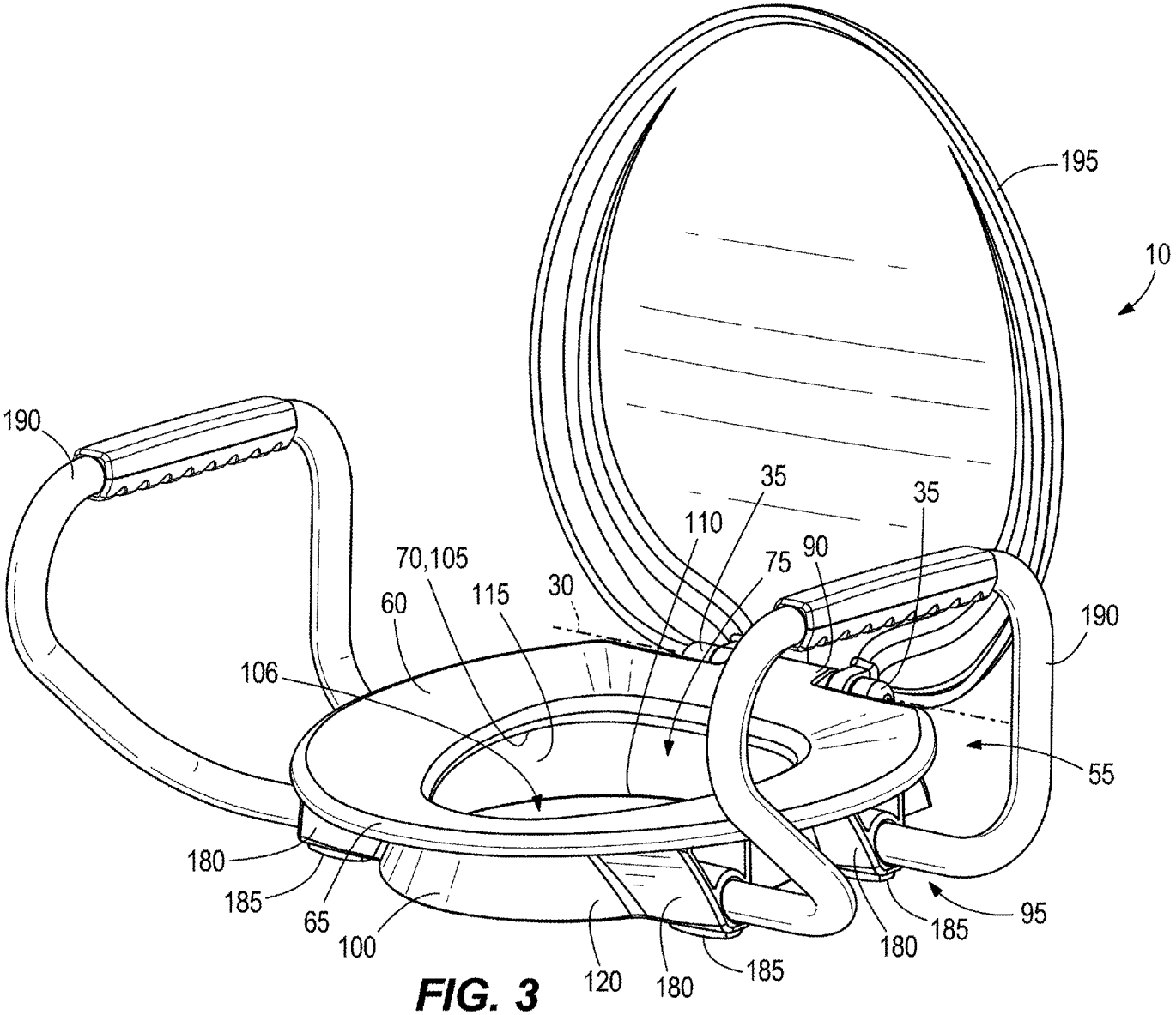
FIG. 3 is a perspective view of the elevated toilet seat assembly of FIG. 1.

The illustrated toilet seat 20 is made of plastic. More particularly, the toilet seat 20 is injection molded as a single piece of solid plastic. As such, the below described features of the toilet seat 20 are formed in one injection molding process. With reference to FIGS. 3 and 4, the toilet seat 20 includes an upper portion 55 having a support surface 60 defined between an outer perimeter 65 and an inner perimeter 70 of the upper portion 55. The inner perimeter 70 is an inner seat edge of the upper portion 55 and defines a central or top opening 75 of the toilet seat 20. As best shown in FIG. 4, the upper portion 55 defines a maximum thickness 80 (e.g., a maximum height of the upper portion 55) between about 0.35 inches and about 0.85 inches. The maximum thickness 80 is measured from the support surface 60 to a bottom surface 85 of the upper portion 55. In other embodiments, the maximum thickness 80 of the upper portion 55 is about 0.6 inches. Furthermore, the upper portion 55 includes a protrusion 90 to couple with the hinge post 25 (FIGS. 4 and 5).

The toilet seat 20 also includes a lower portion 95 extending from the bottom surface 85 of the upper portion 55 (FIG. 4). The lower portion 95 includes a shield or guard 100 having an upper edge 105 (FIGS. 3 and 5) defined by the inner perimeter 70 of the upper portion 55, a lower edge or inner guard edge 110 opposite the upper edge 105 defining a bottom opening 106 of the toilet seat 20, and an inner surface 115 and an outer surface 120 extending between the upper edge 105 and the lower edge 110. The guard 100 defines a height 125 of about 2.12 inches to about 2.62 inches. In other embodiments, the height 125 is about 2.375 inches. The height 125 is measured from the upper edge 105 to the lower edge 110 of the guard 100. As such, a ratio of the height 125 over the maximum thickness 80 of the upper portion 55 is between about 3 and about 6. In other embodiments, the ratio of the height 125 over the maximum thickness 80 of the upper portion 55 is about 4. The illustrated guard 100 tapers from the lower edge 110 to the upper edge 105. With reference to FIG. 4, the guard 100 includes a nonlinear taper (e.g., a curved taper) that gradually and continuously tapers from the lower edge 110 to the upper edge 105. In other embodiments, the guard 100 can include a linear taper. In further embodiments, the guard 100 can be a stepped taper and/or include portions without any taper and other portions with angled tapers. In yet further embodiments, the guard 100 can include a discontinuous taper from the lower edge 110 to the upper edge 105. In addition, the illustrated guard 100 continuously and completely surrounds the central opening 75 of the upper portion 55 (FIG. 5), and the guard 100 does not extend outwardly beyond the outer perimeter 65 of the upper portion 55 (FIGS. 4 and 5). For example, the lower edge 110 is positioned between the outer perimeter 65 and the inner perimeter 70 of the upper portion 55 as shown in FIG. 5.

Figure 5:
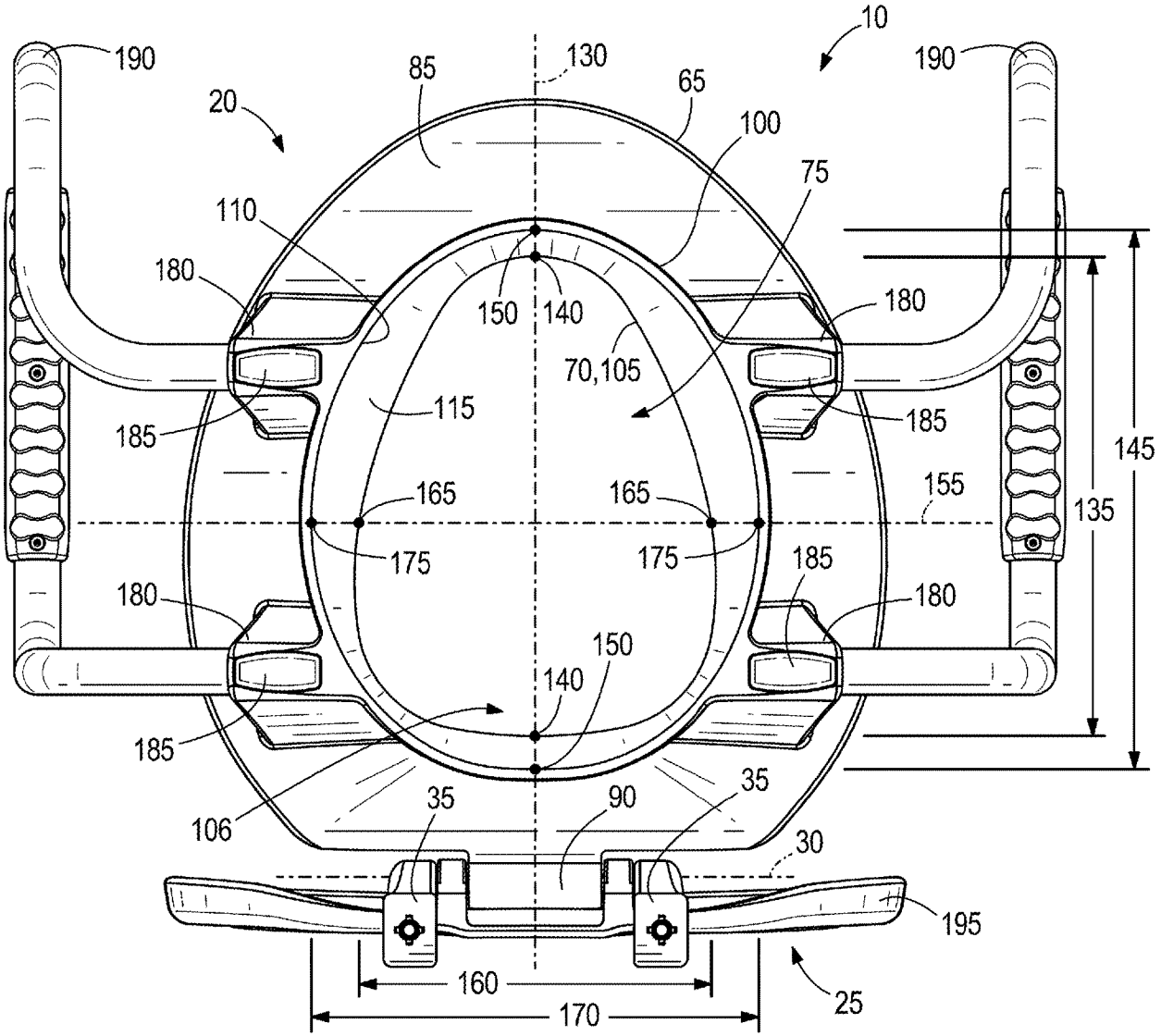
FIG. 5 is a bottom view of the elevated toilet seat assembly of FIG. 3.

With continued reference to FIG. 5, a longitudinal plane 130 (e.g., a first plane) is oriented perpendicular to the axis 30 and extends through the top opening 75 and the bottom opening 106 of the toilet seat 20. As such, the longitudinal plane 130 is also oriented perpendicular to the rim surface 32 of the toilet 15 and extends through the top opening 75 and the bottom opening 106 when the toilet seat 20 is in the in-use position. FIG. 5 shows one position of the longitudinal plane 130 (e.g., extending centrally through the top and bottom openings 75, 160), but the longitudinal plane 130 can also be positioned differently (e.g., right or left of the longitudinal plane 130 as illustrated in FIG. 5) as long as the longitudinal plane 130 is oriented perpendicular to the axis 30. With continued reference to FIG. 5, a first distance 135, which is measured within the longitudinal plane 130 between opposing points 140 on the upper edge 105, is less than a second distance 145, which is measured within the longitudinal plane 130 between opposing points 150 on the lower edge 110.

The guard 100 also includes a lateral plane 155 (e.g., a second plane; FIG. 5) oriented parallel to the axis 30 and oriented perpendicular to the rim surface 32 of the toilet 15 when the toilet seat 20 is in the in-use position. The lateral plane 155 also extends through the top opening 75 and the bottom opening 106. FIG. 5 shows one position of the lateral plane 155 (e.g., extending centrally through the top and bottom openings 75, 160), but the lateral plane 155 can also be positioned differently (e.g., above or below the lateral plane 155 as illustrated in FIG. 5) as long as the lateral plane 155 is oriented parallel to the axis 30 and perpendicular to the rim surface 32 when the toilet seat 20 is in the in-use position. With continued reference to FIG. 5, a third distance 160, which is measured within the lateral plane 155 between opposing points 165 on the upper edge 105, is less than a fourth distance 170, which is measured within the lateral plane 155 between opposing points 175 on the lower edge 110. Stated another way, a maximum dimension of the upper edge 105 of the support surface 60 (e.g., a distance separating points 140) is less than a maximum dimension of the lower edge 110 of the guard 100 (e.g., a distance separating points 150). As such, in one embodiment, the maximum dimension of the upper edge 105 and the lower edge 110 can be measured perpendicular to the axis 30. In other embodiments, the maximum dimension of the upper edge 105 and the lower edge 110 can be measured parallel to the axis 30 such that the maximum dimension of the upper edge 105 (e.g., a distance separating points 165) is less than the maximum dimension of the lower edge 110 (e.g., a distance separating points 175).

With reference to FIG. 5, a plurality of supports 180 extend outwardly from the outer surface 120 of the guard 100 toward the outer perimeter 65 of the upper portion 55. In other words, each support 180 extends from the outer surface 120 of the guard 100 substantially parallel to the axis 30. In the illustrated embodiment, each support 180 extends along the entire height 125 of the guard 100 from the bottom surface 85 of the upper portion 55 to the lower edge 110 of the guard 100 (FIG. 4). For example, the height 125 of the guard 100 is generally the same height of the supports 180, which is greater than the maximum thickness 80 of the upper portion 55. In other embodiments, at least one support 180 can extend a portion of the height 125 of the guard 100 (e.g., from a midway of the guard 100 to the lower edge 110). The supports 180 are formed within the foot print area of the upper portion 55 (i.e., the supports 180 do not extend outwardly beyond the outer perimeter 65 of the support surface 60). The illustrated supports 180 include two pairs of supports, with each pair positioned on opposite sides of the guard 100 and extending away from each other (FIG. 5). In other embodiments, the supports 180 can include more or less than four supports and/or be arranged differently around the guard 100. For example, the toilet seat 20 can include at least one support 180 that extends away/toward the protrusion 90 (extending transverse (e.g., non-parallel) to the axis 30). In the illustrated embodiment, each support 180 includes a foot 185 positioned on one end of the support 180. Each foot 185 extends below the lower edge 110 of the guard 100 (FIG. 4). In other embodiments, each foot 185 can be a separate member (e.g., a rubber foot) from the toilet seat 20 that can be coupled to the end of each support 180. In such embodiments, the feet 185 provide a softer contact surface that reduces the possibility of marring or noisily engaging the toilet 15 during use.

As shown in FIGS. 3-5, the toilet seat assembly 10 also includes two support handles or arms 190 for a person to stabilize themselves sitting down on the toilet seat 20, during use of the toilet seat 20, and/or standing up from the toilet seat 20. In particular, each arm 190 is tubular in construction and is fixed to a pair of supports 180. In other embodiments, the arms 190 can be removably coupled to the toilet seat 20. In some embodiments, the support handles 190 can be plastic injection molded with the toilet seat 20 as one component. In further embodiments, the toilet seat assembly 10 can omit the support handles 190.

The illustrated toilet seat assembly 10 also includes a lid 195 that is pivotably coupled to the hinge posts 25 and the protrusion 90 about the axis 30 to selectively cover the central opening 75 of the toilet seat 20.

As the toilet seat 20 is moved from the upright position (FIG. 1) to the in-use position (FIG. 2), the feet 185 of the supports 180 engage the rim surface 32 of the toilet 15 to support the toilet seat 20 at an elevated height above the rim surface 32. Accordingly, the bottom surface 85 of the upper portion 55 is positioned away from the rim surface 32 of the toilet 15 (e.g., the bottom surface 85 does not engage the rim surface 32). In the illustrated embodiment, the support surface 60 of the toilet seat 20 is positioned between about 3 inches and about 5 inches above the rim surface 32 once the toilet seat 20 is in the in-use position. Accordingly, the elevated height of the support surface 60 assists in helping a person sit down on the support surface 60 or stand up from the support surface 60 before/after use. Furthermore, the guard 100 is operable to block waste from splashing out of the toilet 15 during use.

As best shown in FIG. 4, as the feet 185 extend beyond the lower edge 110 of the guard 100 to engage the rim surface 32 of the toilet 15, the lower edge 110 is positioned above the rim surface 32 (e.g., the lower edge 110 does not extend below the rim surface 32 into the toilet 15). In other embodiments, the feet 185 can be omitted so that the lower edge 110 of the guard 100 is positioned substantially level with the rim surface 32 when the supports 180 engage the rim surface 32. Because the guard 100 does not extend into the toilet 15, the toilet seat 20 is operably universal with many different types of toilets 15 (e.g., U.S. style round toilets, U.S. style elongated toilets, European style toilets, etc.).

Although the invention has been described in detail with reference to certain preferred embodiments, variations and modifications exist within the scope and spirit of one or more independent aspects of the invention as described. Various features and advantages of the invention are set forth in the following claims.

The invention claimed is:

1. An elevated toilet seat assembly for a toilet, the elevated toilet seat assembly comprising:

a hinge post configured to be engageably coupled to the toilet; and a toilet seat coupled to the hinge post in at least an in-use position, the toilet seat made from a single piece of injection molded plastic, the toilet seat including:

a support surface including top edge defining a top opening of the toilet seat, the support surface configured to support a person on the toilet seat, a guard extending below the support surface, the guard having a bottom edge defining a bottom opening of the toilet seat, the guard tapering from the bottom edge of the guard toward the top edge of the support surface, the guard configured to block waste from splashing out of the toilet during use, and a plurality of supports extending outwardly from an outer surface of the guard, the plurality of supports configured to position the support surface at an elevated height above a rim of the toilet, the plurality of supports configured to position the guard relative to the rim of the toilet such that the bottom edge of the guard is positioned above the rim of the toilet when in the in-use position.

2. The elevated toilet seat assembly of claim 1, wherein a first plane is configured to be perpendicular to the rim of the toilet and extends through the top and bottom openings when the toilet seat is in the in-use position, and wherein a first distance, measured within the first plane between opposing points on the top edge of the support surface, is less than a second distance, measured within the first plane between opposing points on the bottom edge of the guard.

3. The elevated toilet seat assembly of claim 2, wherein the first plane is perpendicular to the axis.

4. The elevated toilet seat assembly of claim 3, wherein a second plane is perpendicular to the first plane and extends through the top and bottom openings when the toilet seat is in the in-use position, and wherein a third distance, measured within the second plane between opposing points on the inner top edge of the support surface, is less than a fourth distance, measured within the second plane between opposing points on the bottom edge of the guard.

5. The elevated toilet seat assembly of claim 1, wherein the plurality of supports includes a plurality of feet extending beyond the bottom edge of the guard in a direction away from the support surface, and wherein the plurality of feet is configured to directly engage the rim of the toilet.

6. The elevated toilet seat assembly of claim 1, further comprising a plurality of support handles coupled to the plurality of supports, wherein the plurality of support handles is configured to be gripped by the person to assist the person in sitting down on the toilet seat or standing up from the toilet seat.

7. An elevated toilet seat assembly for a toilet, the elevated toilet seat assembly comprising:

a toilet seat configured to be pivotably coupled to the toilet about an axis, the toilet seat made from a single piece of injection molded plastic, the toilet seat including:

a support surface having an inner top edge defining a top opening of the toilet seat, the top opening having a first area defined by the inner top edge, the support surface configured to support a person on the toilet seat, and a guard extending below the support surface, the guard having an inner bottom edge defining a bottom opening of the toilet seat, the bottom opening having a second area defined by the inner bottom edge, the guard configured to block waste from splashing out of the toilet during use, wherein the guard tapers from the inner bottom edge of the guard toward the inner top edge of the support surface such that the first area of the top opening is less than the second area of the bottom opening.

8. The elevated toilet seat assembly of claim 7, wherein the toilet seat includes a plurality of supports extending from the guard, wherein the plurality of supports is configured to position the support surface at an elevated height above a rim of the toilet.

9. The elevated toilet seat assembly of claim 8, wherein the plurality of supports is configured to position the guard relative to the rim of the toilet such that no portion of the guard extends into the toilet.

10. The elevated toilet seat assembly of claim 9, wherein the plurality of supports includes a plurality of feet configured to directly engage the rim of the toilet.

11. The elevated toilet seat assembly of claim 7, further comprising a plurality of support handles coupled to the plurality of supports, wherein the plurality of support handles is configured to be gripped by the person to assist the person in sitting down on the toilet seat or standing up from the toilet seat.

12. The elevated toilet seat assembly of claim 7, further comprising a hinge post configured to be engageably coupled to the toilet, wherein the inner bottom edge of the guard is configured to be positioned above a rim of the toilet when the toilet seat is in an in-use position relative to the toilet.

13. An elevated toilet seat assembly for a toilet, the elevated toilet seat assembly comprising:

a toilet seat configured to be pivotably coupled to the toilet about an axis in at least an in-use position in which the toilet seat engages a rim surface of the toilet, the toilet seat made from a single piece of injection molded plastic and including:

a support surface having an inner top edge defining a top opening, the support surface configured to support a person on the toilet seat, and a guard extending below the support surface, the guard having an inner bottom edge defining a bottom opening of the toilet seat, the guard configured to block waste from splashing out of the toilet during use, wherein a plane is configured to be perpendicular to the rim surface of the toilet and extends through the top and bottom openings when the toilet seat is in the in-use position, and wherein a first distance, measured within the plane between opposing points on the inner top edge, is less than a second distance, measured within the plane between opposing points on the inner bottom edge.

14. The elevated toilet seat assembly of claim 13, wherein the plane is a first plane perpendicular to the axis.

15. The elevated toilet seat assembly of claim 14, wherein a second plane is perpendicular to the first plane and extends through the top and bottom openings when the toilet seat is in the in-use position, and wherein a third distance, measured within the second plane between opposing points on the inner top edge of the support surface, is less than a fourth distance, measured within the second plane between opposing points on the inner bottom edge of the guard.

16. The elevated toilet seat assembly of claim 13, wherein the toilet seat includes a plurality of supports extending from the guard, wherein the plurality of supports is configured to position the support surface at an elevated height above the rim surface of the toilet, and wherein the plurality of supports is configured to position the guard relative to the rim surface of the toilet such that no portion of the guard extends into the toilet.

17. The elevated toilet seat assembly of claim 16, wherein the plurality of supports includes a plurality of feet configured to directly engage the rim surface of the toilet.

* * * * *